US006976642B2

(12) United States Patent
Albrodt et al.

(10) Patent No.: US 6,976,642 B2
(45) Date of Patent: Dec. 20, 2005

(54) DUAL COMPONENT INJECTOR

(75) Inventors: Hartmut Albrodt, Tamm (DE); Ralf Bruenemann, Stuttgart (DE); Ulrich Fischer, Ditzingen (DE); Markus Gesk, Karlsbad (DE); Simon Godwin, Stuttgart (DE); Eberhard Holder, Kusterdingen (DE); Roland Kemmler, Stuttgart (DE); Martin Matt, Bruchsal (DE); Ferdinand Reiter, Markgroeningen (DE)

(73) Assignees: DaimlerChrysler AG, Stuttgart (DE); Robert Bosch GmbH, Stuttgart-Feuerbach (DE)

( * ) Notice: Subject to any disclaimer, the term of this patent is extended or adjusted under 35 U.S.C. 154(b) by 128 days.

(21) Appl. No.: 10/292,809

(22) Filed: Nov. 13, 2002

(65) Prior Publication Data

US 2003/0213858 A1 Nov. 20, 2003

(30) Foreign Application Priority Data

Nov. 17, 2001 (DE) ..... 101 56 657

(51) Int. Cl.[7] ..... B05B 7/12

(52) U.S. Cl. ..... 239/407; 239/403; 239/433; 239/584; 239/585.1

(58) Field of Search ..... 239/88, 403, 405, 239/407, 413, 424, 426, 433, 434, 583, 584, 239/585.1; 123/25 C, 299, 455, 575

(56) References Cited

U.S. PATENT DOCUMENTS 3,656,693 A * 4/1972 Eckert ..... 239/403
4,499,862 A * 2/1985 Baumer et al. ..... 123/299
4,676,216 A * 6/1987 Ohsawa et al. ..... 239/418
4,736,712 A * 4/1988 Savkar et al. ..... 123/575
4,782,794 A * 11/1988 Hsu et al. ..... 239/88
5,035,358 A * 7/1991 Katsuno et al. ..... 239/403
5,299,919 A * 4/1994 Paul et al. ..... 129/455
5,529,024 A * 6/1996 Wirbeleit et al. ..... 123/25 C
6,209,806 B1 * 4/2001 Pace et al. ..... 239/407

FOREIGN PATENT DOCUMENTS

DE 1 863 046 11/1962
DE 3909750 C2 11/1991
DE 4203144 A1 8/1993
DE 4422552 C1 11/1995
DE 19650559 C1 3/1998
DE 19959581 A1 6/2001

* cited by examiner

*Primary Examiner*—Steven J. Ganey
(74) *Attorney, Agent, or Firm*—Crowell & Moring LLP

(57) ABSTRACT

A dual component injector, especially for internal combustion engines, has a nozzle body, which has a nozzle outlet, and a valve needle for opening and closing the nozzle outlet. A first feed channel is used for supplying a first fluid to the nozzle outlet, and a second feed channel is used for supplying a second fluid to the nozzle outlet. Optionally, a fluid chamber, which is located in the nozzle body, is connected to the nozzle outlet. The second feed channel is connected to the fluid chamber or to the first feed channel via at least two bored holes. The bored holes open out in the fluid chamber or in the first feed channel in such a way that the second fluid produces a swirling flow pattern in the fluid chamber or in the first feed channel.

29 Claims, 3 Drawing Sheets

DUAL COMPONENT INJECTOR

This application claims the priority of German application 101 56 657.3, filed Nov. 17, 2001, the disclosure of which is expressly incorporated by reference herein.

BACKGROUND AND SUMMARY OF THE INVENTION

The present invention pertains to a dual component injector, especially for internal combustion engines, with a nozzle body that has a nozzle outlet, a valve needle for opening and closing the nozzle outlet, a first feed channel for supplying a first fluid to the nozzle outlet, a second feed channel for supplying a second fluid to the nozzle outlet, and, optionally, a fluid chamber which is located in the nozzle body and which is connected to the nozzle outlet.

Dual component injectors of this type are used, for example, during the start-up phase in internal combustion engines in order to inject into the combustion chamber a fuel that is different from the fuel used for normal operation. A low boiling fuel is usually injected for the start-up of the internal combustion engine, making it possible to comply with considerably more stringent exhaust emission standards than with a conventional injection process. A principal advantage of dual component injectors used in this way resides in the very small changes that have to be implemented in the internal combustion engine itself, together with the fact that the standard wiring and ignition of the internal combustion engine can be adopted in their entirety.

German publication DE 39 09 750 C2 describes a similar process in the form of a start-up aid for an internal combustion engine.

A dual component injector of this type is known from German publication DE 199 59 851 A1. In this case, a slide gate is arranged in one chamber of the nozzle body, and, depending on its position, this slide gate either connects the first feed channel or the second feed channel to the nozzle outlet.

One disadvantage of this injector resides in the fact that the start-up fuel and the fuel that is used for normal operation are capable of intermixing very readily. After the internal combustion engine has been switched off, and thus prior to the following start-up thereof, normal fuel is still located in the region of the nozzle outlet, which leads to this normal fuel being injected into the combustion chamber during the first injection process.

However, this runs counter to the actual basic idea behind these injectors, i.e. straight away at the start-up phase of the internal combustion engine to inject into the combustion chambers the start-up fuel that is intended for this purpose. Furthermore, this slide gate has proven to be unsuitable in practice, especially with regard to its sealing performance and its response characteristics.

One object of the present invention is therefore to create a dual component injector that ensures that, straight away during the first injection process, only the second fluid, which is specifically intended for this purpose, is released via the nozzle outlet. In addition, the dual component injector specified in the invention should have a simple structure and hence exhibit a high degree of reliability.

In accordance with the invention, the second feed channel is connected to the fluid chamber or to the first feed channel via at least two bored holes. The bored holes open out in the fluid chamber or the first feed channel in such a way that the second fluid produces a swirling flow pattern in the fluid chamber or in the first feed channel.

As a consequence of the drilled out holes in accordance with the invention, which connect the second feed channel to the fluid chamber or to the first feed chamber, and which are arranged in such a way that the second fluid produces a swirling flow pattern in the fluid chamber or in the first feed channel, the start-up fuel (when the dual component injector specified in the invention is used e.g. in an internal combustion engine) is capable (as a result of the swirling flow pattern that is being produced) of displacing normal fuel or, more generally, the first fluid, which may still be located in the fluid chamber or in the first feed channel, from the nozzle outlet without becoming intermixed with it. As a result, only the start-up fuel is located in the vicinity of the nozzle outlet and, during the first lifting off phase of the needle valve, only start-up fuel, or the second fluid, is released via the nozzle outlet.

In this manner, an extremely functional dual component injector is created at very low cost in terms of construction, especially since there is no movement of mechanical components in the interior of the injector, while this dual component injector, when used in internal combustion engines in particular, ensures the production of a very low quantity of injurious substances straight away during the start-up process, and consequently allows compliance with very low emission values.

Naturally, the dual component injector specified in the invention can also be used in other applications, e.g. in air conditioning units, humidifiers, and reformers of fuel cells.

Advantageous embodiments and further developments of the invention arise from the subsidiary claims as well as from the following example of an embodiment that is illustrated in principle by way of the drawings.

DETAILED DESCRIPTION OF THE INVENTION

Figure 1:
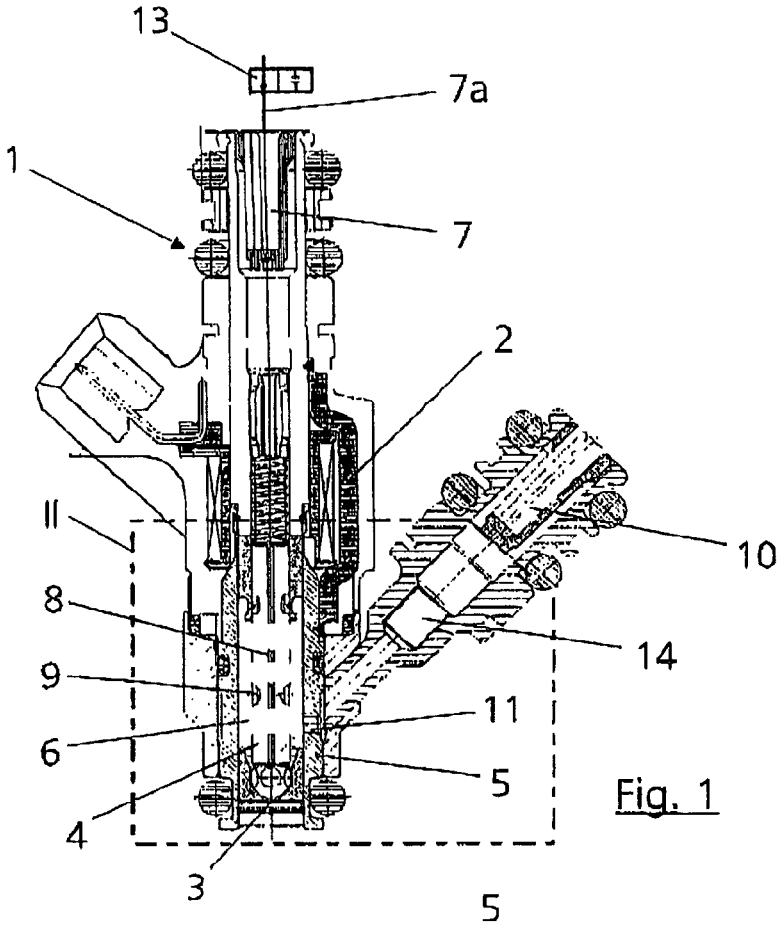
FIG. 1 shows a section through a dual component injector in accordance with the invention.
Figure 2:
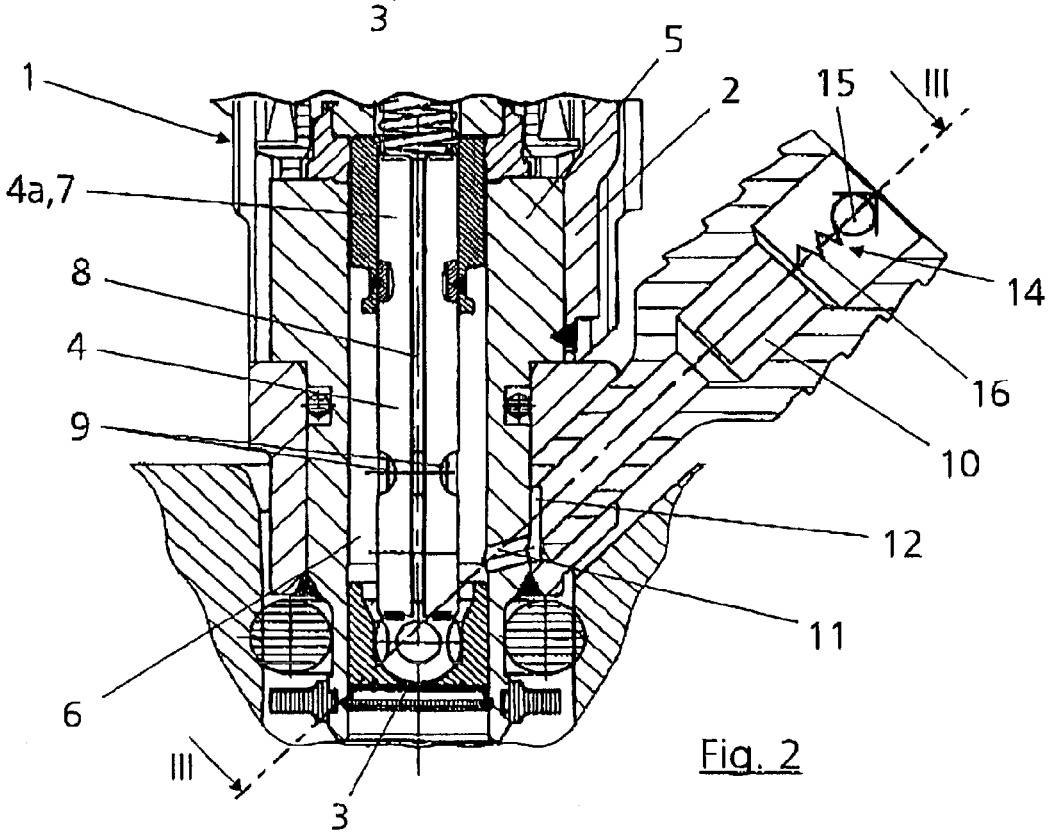
FIG. 2 shows an enlarged illustration of area II of FIG. 1.
Figure 3:
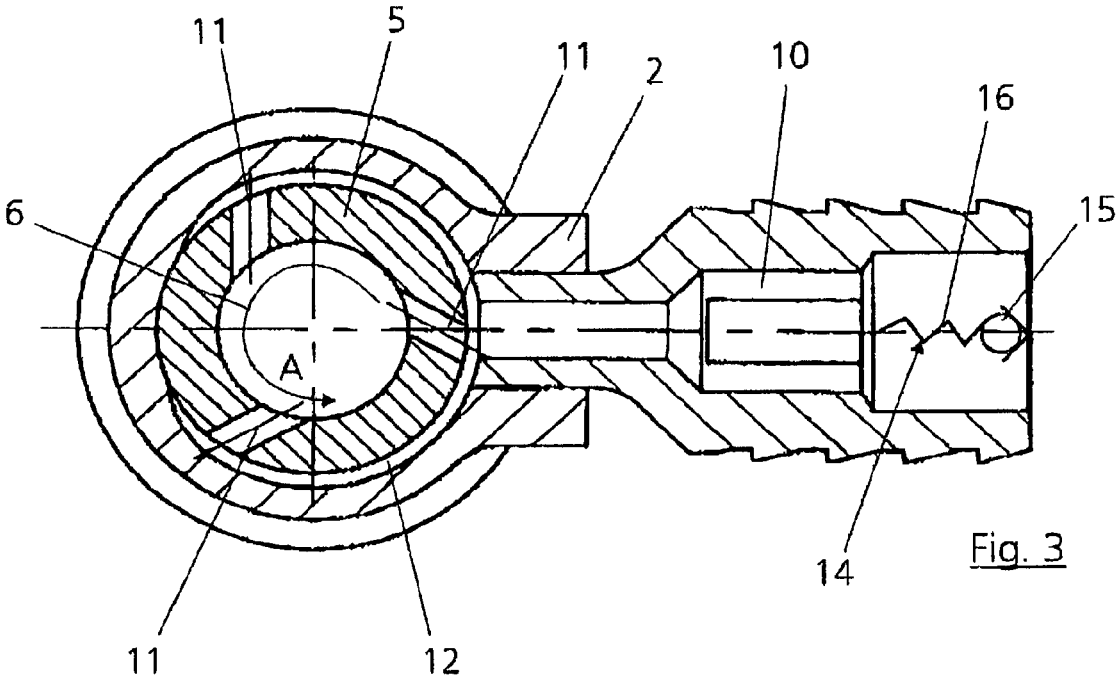
FIG. 3 shows a section along line III—III of FIG. 2.

FIG. 1 shows a section through the dual component injector 1 that can serve for injecting fuel into a combustion chamber, which is not illustrated here, of an internal combustion engine that likewise is not illustrated. The use of the dual component injector 1 will be described below in connection with an internal combustion engine, although it is also possible to use the injector in air conditioning units, humidifiers, reformers of fuel cells, or similar devices.

The dual component injector 1 has a nozzle body 2 that is provided with a nozzle outlet 3 at its front end.

During operation of the dual component injector 1, fuel is injected through the nozzle outlet 3 into the relevant combustion chamber of the internal combustion engine. A valve needle 4 is mounted movably in the nozzle body 2; this valve needle is provided in order to open or close the nozzle outlet 3 in a way that is known as such in order to implement an injection process. A fluid chamber 6 is constructed between the valve needle 4 and a housing component 5 that is a component of the nozzle body 2. The fluid collects in this fluid chamber prior to exiting the dual component injector 1 via the nozzle outlet 3.

A first feed channel 7 runs along within the interior of the nozzle body 2, and has several slots 8 and several openings 9 in the direction of the fluid chamber 6. A first fluid, which in the present case is the fuel that is intended for the normal operation of the internal combustion engine, is able to enter the fluid chamber 6 via the slots 8 and the openings 9. The valve needle 4 has an internal zone 4*a*, which forms part of the first feed channel 7 and through which the first fluid is fed during operation.

The dual component injector 1 also has a second feed channel 10 that is attached to the nozzle body 2 and serves to supply a second fluid to the nozzle outlet 3. The first feed channel 7 and the second feed channel 10 can, in principle, be arranged in any desired manner relative to one another in order to achieve flow toward the nozzle outlet 3. In the case of an internal combustion engine, as described here, the second fluid is a start-up fuel that is used in the start-up phase and has a relatively low boiling point. The fluid in question enters the two feed channels 7 and 10 from containers that are not illustrated here.

In the present case, three bored holes 11, which run through the housing component 5, lead from the second feed channel 10 to the fluid chamber 6 and open out in the fluid chamber 6 in such a way that the second fluid produces a swirling flow pattern there. In the present case, this swirling flow pattern in the fluid chamber 6 is achieved as a result of the fact that each of the three bored holes 11, which are arranged in such a way that they are displaced by an angle of approximately 120° relative to one another, runs approximately tangentially to the inner wall of the housing component 5. In this way, the second fluid flows along this inner wall, into the fluid chamber 6, and moves inside the fluid chamber 6 in the direction of the arrow A. As a result of the arrangement of the drilled out holes 11, which is only approximately tangential but not perfectly so, potential tolerance and production problems during manufacture are prevented.

The swirling flow pattern that is produced in this manner displaces the first fluid, which can still be located in the fluid chamber 6 at the time the second fluid is introduced, upward and opposite to the injection direction without becoming intermixed with it. In this manner, the first fluid is prevented from leaving the dual component injector 1 through the nozzle outlet 3 when the second fluid is introduced into the fluid chamber 6 via the second feed channel 10 prior to the first opening of the nozzle outlet 3. On the contrary, it is ensured that only the second fluid leaves the nozzle outlet 3 straight away at the time of this first opening of the nozzle outlet and, in this way, only the specific start-up fuel, which is intended for this purpose, is injected into the combustion chamber of the internal combustion engine.

A zone 12, which is constructed in a partially annular form, is located outside the housing component 5, and is connected to the second feed channel 10, wherein the bored holes 11 emerge from this zone. The zone 12, which ensures uniform distribution of the second fluid within the individual bored holes 11, could also be constructed, if required, with a completely annular cross-section. Naturally, it would also be possible to install a different number of bored holes 11 in the housing component 5.

In order to permit variations in the quantity of fuel that can be displaced in the first feed channel 7, a valve 13, e.g. a 2/2-way valve, is arranged in a supply line 7*a* that leads to the first feed channel 7, wherein this valve is capable of being switched from one setting to another. The valve 13 also ensures that start-up fuel cannot enter the supply line 7*a* so that the rinsing phase for the fluid chamber 6, which has been described above, is made possible by appropriate switching of the settings of the valve 13.

A check valve 14 is located in the second feed channel 10, and permits the second fluid to flow through in the direction of the nozzle outlet 3, preventing the first fluid from entering the second feed channel 10. In addition to a valve body 15, the check valve 14 has a spring element 16 with a spring constant which has been matched to the boiling characteristics of the second fluid; as a result of this, with the appropriate vapor pressure for the second fluid, this second fluid is prevented from penetrating into the fluid chamber 6 in an uncontrolled manner when the internal combustion engine is in its warm state.

After the internal combustion engine has been switched off, the first fluid remains behind in the region of the nozzle outlet 3. Because, at the same temperature, the first fluid has a significantly lower vapor pressure than the second fluid, there is significantly less leakage in the area of the nozzle outlet 3 than if the second fluid were waiting there. As described above, the first fluid is displaced from the nozzle outlet by the second fluid prior to the next start-up of the internal combustion engine.

Figure 4:
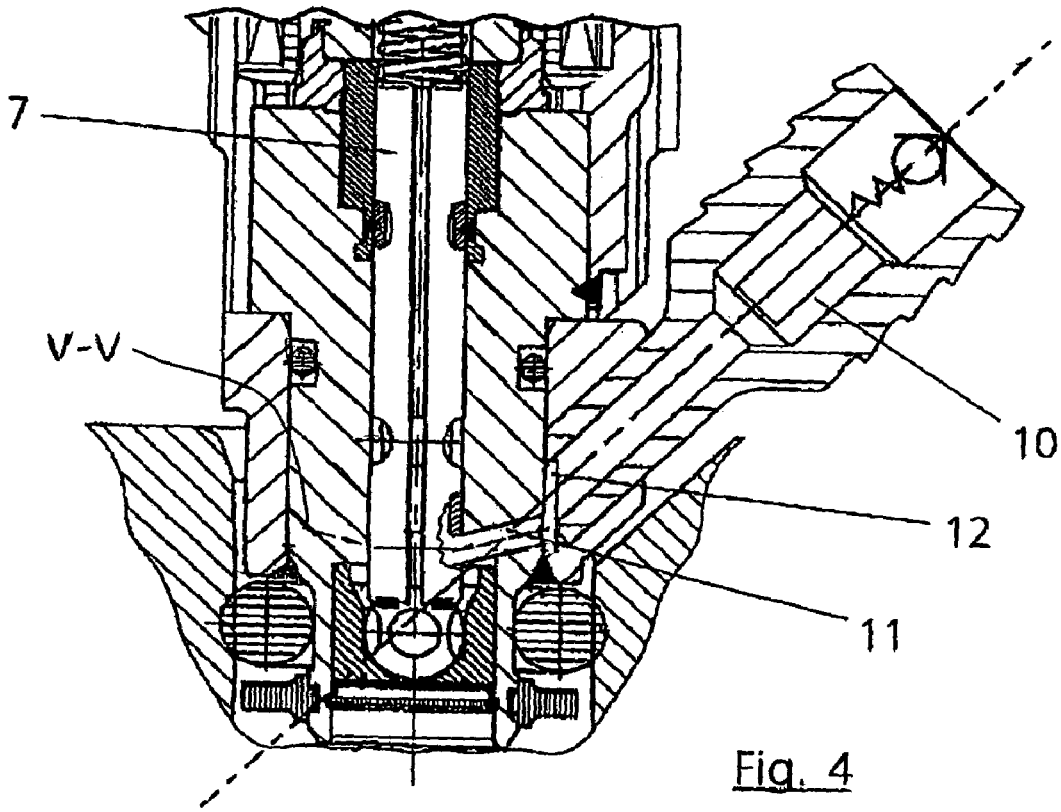
FIG. 4 shows a section similar to that of FIG. 1 through another injector.
Figure 5:
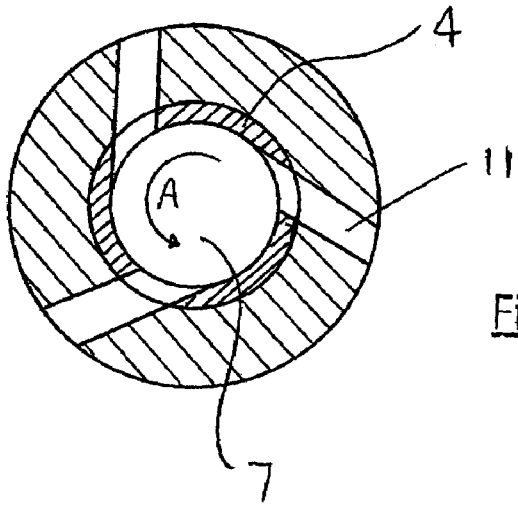
FIG. 5 shows a section similar to that of FIG. 3 but along line V—V of FIG. 4.

As illustrated, the fluid chamber 6 is provided between the first feed channel 7 and the second feed channel 10, and this fluid chamber ensures a more uniformly equal distribution of the fuel prior to injection. If required, however, the fluid chamber 6 could be dispensed with. In this case, as shown by way of example only in FIGS. 4 and 5, the second feed channel 10 would open out directly into the first feed channel 7, and the bored holes 11 would be arranged directly between the two feed channels 7 and 10, and would connect these channels to one another.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

We claim:

1. A dual component injector comprising:

a nozzle body which has a nozzle outlet, a valve needle for opening and closing the nozzle outlet, a first feed channel for supplying a first fluid to the nozzle outlet, a second feed channel for supplying a second fluid to the nozzle outlet, and a fluid chamber, which is located in the nozzle body and which is connected to the nozzle outlet, wherein the second feed channel is connected to the fluid chamber or to the first feed channel via at least two bored holes, and wherein the bored holes open out in the fluid chamber or the first feed channel in such a way that the second fluid flows along an inner wall enclosing the fluid chamber or the first feed channel and produces a swirling flow pattern in the fluid chamber or in the first feed channel.

2. The dual component injector in accordance with claim 1, wherein the injector is for an internal combustion engine.

3. A dual component injector comprising:

a nozzle body which has a nozzle outlet, a valve needle for opening and closing the nozzle outlet, a first feed channel for supplying a first fluid to the nozzle outlet, a second feed channel for supplying a second fluid to the nozzle outlet, and a fluid chamber, which is located in the nozzle body and which is connected to the nozzle outlet, wherein the second feed channel is connected to the fluid chamber or to the first feed channel via at least two bored holes, wherein the bored holes open out in the fluid chamber or the first feed channel in such a way that the second fluid produces a swirling flow pattern in the fluid chamber or in the first feed channel, wherein the bored holes are arranged in a housing component of the nozzle body, and wherein the housing component separates the first feed channel from the second feed channel.

4. The dual component injector in accordance with claim 3, wherein a zone, which is constructed in at least a partially annular form, is located outside the housing component, and wherein the bored holes emerge from this zone.

5. The dual component injector in accordance with claim 4, wherein three of said bored holes are provided in such a way that they are displaced relative to one another by approximately 120°.

6. The dual component injector in accordance with claim 4, and further comprising a valve, which is capable of being switched from one setting to another, arranged in the first feed channel.

7. The dual component injector in accordance with claim 4, and further comprising a check valve arranged in the second feed channel.

8. The dual component injector in accordance with claim 7, wherein the check valve has a spring element with a spring constant which has been matched to boiling characteristics of the second fluid.

9. The dual component injector in accordance with claim 3, wherein three of said bored holes are provided in such a way that they are displaced relative to one another by approximately 120°.

10. The dual component injector in accordance with claim 3, and further comprising a valve, which is capable of being switched from one setting to another, arranged in the first feed channel.

11. The dual component injector in accordance with claim 3, and further comprising a check valve arranged in the second feed channel.

12. The dual component injector in accordance with claim 11, wherein the check valve has a spring element with a spring constant which has been matched to boiling characteristics of the second fluid.

13. A dual component injector comprising:

a nozzle body which has a nozzle outlet, a valve needle for opening and closing the nozzle outlet, a first feed channel for supplying a first fluid to the nozzle outlet, a second feed channel for supplying a second fluid to the nozzle outlet, and a fluid chamber, which is located in the nozzle body and which is connected to the nozzle outlet, wherein the second feed channel is connected to the fluid chamber or to the first feed channel via at least two bored holes, wherein the bored holes open out in the fluid chamber or the first feed channel in such a way that the second fluid produces a swirling flow pattern in the fluid chamber or in the first feed channel, and wherein three of said bored holes are provided in such a way that they are displaced relative to one another by approximately 120°.

14. The dual component injector in accordance with claim 13, and further comprising a valve, which is capable of being switched from one setting to another, arranged in the first feed channel.

15. The dual component injector in accordance with claim 13, and further comprising a check valve arranged in the second feed channel.

16. The dual component injector in accordance with claim 15, wherein the check valve has a spring element with a spring constant which has been matched to boiling characteristics of the second fluid.

17. A dual component injector comprising:

a nozzle body which has a nozzle outlet, a valve needle for opening and closing the nozzle outlet, a first feed channel for supplying a first fluid to the nozzle outlet, a second feed channel for supplying a second fluid to the nozzle outlet, a fluid chamber, which is located in the nozzle body and which is connected to the nozzle outlet, and a valve, which is capable of being switched from one setting to another, arranged in the first feed channel, wherein the second feed channel is connected to the fluid chamber or to the first feed channel via at least two bored holes, and wherein the bored holes open out in the fluid chamber or the first feed channel in such a way that the second fluid produces a swirling flow pattern in the fluid chamber or in the first feed channel.

18. The dual component injector in accordance with claim 17, and further comprising a check valve arranged in the second feed channel.

19. The dual component injector in accordance with claim 18, wherein the check valve has a spring element with a spring constant which has been matched to boiling characteristics of the second fluid.

20. A dual component injector comprising:

a nozzle body which has a nozzle outlet, a valve needle for opening and closing the nozzle outlet, a first feed channel for supplying a first fluid to the nozzle outlet, a second feed channel for supplying a second fluid to the nozzle outlet, a fluid chamber, which is located in the nozzle body and which is connected to the nozzle outlet, and a check valve arranged in the second feed channel, wherein the second feed channel is connected to the fluid chamber or to the first feed channel via at least two bored holes, and wherein the bored holes open out in the fluid chamber or the first feed channel in such a way that the second fluid produces a swirling flow pattern in the fluid chamber or in the first feed channel.

21. The dual component injector in accordance with claim 20, wherein the check valve has a spring element with a spring constant which has been matched to boiling characteristics of the second fluid.

22. A dual component injector comprising:

a nozzle body which has a nozzle outlet, a valve needle for opening and closing the nozzle outlet, a first feed channel for supplying a first fluid to the nozzle outlet, and a second feed channel for supplying a second fluid to the nozzle outlet, wherein the second feed channel is connected to the first feed channel via at least two bored holes, and wherein the bored holes open out in the first feed channel in such a way that the second fluid produces a swirling flow pattern in the first feed channel.

23. The dual component injector in accordance with claim 22, wherein the injector is for an internal combustion engine.

24. The dual component injector in accordance with claim 22, wherein the bored holes are arranged in a housing component of the nozzle body, and wherein the housing component separates the first feed channel from the second feed channel.

25. The dual component injector in accordance with claim 24, wherein a zone, which is constructed in at least a partially annular form, is located outside the housing component, and wherein the bored holes emerge from this zone.

26. The dual component injector in accordance with claim 22, wherein three of said bored holes are provided in such a way that they are displaced relative to one another by approximately 120°.

27. The dual component injector in accordance with claim 22, and further comprising a valve, which is capable of being switched from one setting to another, arranged in the first feed channel.

28. The dual component injector in accordance with claim 22, and further comprising a check valve arranged in the second feed channel.

29. The dual component injector in accordance with claim 28, wherein the check valve has a spring element with a spring constant which has been matched to boiling characteristics of the second fluid.

* * * * *